US011487312B2

(12) United States Patent
Migliavacca

(10) Patent No.: US 11,487,312 B2
(45) Date of Patent: Nov. 1, 2022

(54) COMPENSATION FOR LOW DROPOUT VOLTAGE REGULATOR

(71) Applicant: SEMICONDUCTOR COMPONENTS INDUSTRIES, LLC, Phoenix, AZ (US)

(72) Inventor: Paolo Migliavacca, Mauzac (FR)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 128 days.

(21) Appl. No.: 16/832,113

(22) Filed: Mar. 27, 2020

(65) Prior Publication Data

US 2021/0303014 A1 Sep. 30, 2021

(51) Int. Cl.
*G05F 1/575* (2006.01)

(52) U.S. Cl.
CPC ..... *G05F 1/575* (2013.01)

(58) Field of Classification Search
CPC ..... H02M 1/32; H02M 1/325; H02M 1/08; H02M 7/537; H02M 7/5387; H03K 19/20
See application file for complete search history.

(56) References Cited

U.S. PATENT DOCUMENTS

| | | | | |
|---|---|---|---|---|
| 8,716,993 | B2 | 5/2014 | Kadanka et al. | |
| 8,922,179 | B2 | 12/2014 | Kadanka et al. | |
| 2009/0115382 | A1* | 5/2009 | Hasegawa | G05F 1/575 323/273 |
| 2011/0018510 | A1* | 1/2011 | Gao | G05F 1/575 323/280 |

(Continued)

FOREIGN PATENT DOCUMENTS

| | | | |
|---|---|---|---|
| EP | 2919088 | B1 | 5/2019 |
| KR | 100969964 | B1 | 7/2010 |

OTHER PUBLICATIONS

"NCP160; LDO Regulator, Ultra-Low Noise and High PSRR, for RF and Analog Circuits, 250 mA"; White Paper Sep. 2019; Rev. 16; Semiconductor Components Industries, LLC; 5005 East McDowell Road, Phoenix, AZ 85008, United States; 21 pages.

(Continued)

*Primary Examiner* — Kyle J Moody
*Assistant Examiner* — Jye-June Lee
(74) *Attorney, Agent, or Firm* — Polansky & Associates, P.L.L.C.; Paul J. Polansky

(57) ABSTRACT

A low dropout voltage regulator that in one configuration provides a drive signal to regulate an output voltage in response thereto includes an error amplifier, an intermediate amplifier, a buffer amplifier, and a compensation network. The error amplifier has a first input for receiving a reference voltage, a second input for receiving a feedback signal representative of the output voltage, a first output, and a second output. The intermediate amplifier has a first input coupled to the first output of said error amplifier, a second input coupled to the second output of the error amplifier, and an output. The buffer amplifier has a first input coupled to the output of the intermediate amplifier, and an output for providing the drive signal. The compensation network has a first terminal coupled to the first input of the intermediate amplifier, and a second terminal coupled to the output of the intermediate amplifier.

20 Claims, 7 Drawing Sheets

(56) References Cited

U.S. PATENT DOCUMENTS

| | | | | |
|---|---|---|---|---|
| 2013/0082672 | A1* | 4/2013 | Kim | G05F 1/575 323/280 |
| 2013/0271100 | A1* | 10/2013 | El-Nozahi | G05F 1/575 323/280 |
| 2019/0305739 | A1* | 10/2019 | Joo | H03F 3/21 |

OTHER PUBLICATIONS

Rakesh Selvaraj and Shriram Kalusalingam; "Design of Error Amplifier for LDO"; Project Report; Texas A&M University, Department of Electrical and Computer Engineering, 301 Wisenbaker Engineering Building, College Station, TX 77843, United States; 41 pages.

Alfio Dario Grasso, Gaetano Palumbo and Salvatore Pennisi; "Advances in Reversed Nested Miller Compensation"; Regular Paper; IEEE Transactions on Circuits and Systems; vol. 54, No. 7; Jul. 2007; 12 pages.

* cited by examiner

COMPENSATION FOR LOW DROPOUT VOLTAGE REGULATOR

FIELD OF THE DISCLOSURE

This disclosure relates generally to voltage regulators, and more specifically to low dropout voltage regulators (LDOs).

BACKGROUND

Linear voltage regulators provide a direct current (DC) voltage from another DC voltage. For example, low dropout voltage regulators (LDOs) are linear regulators that control a voltage drop across a pass element to regulate an output voltage to a desired level. LDOs are common in linear voltage regulating applications. An LDO is a linear voltage regulator that supplies an output voltage even when the desired output voltage is very close to the input voltage. LDOs typically include an amplifier circuit, a pass element, and a reference circuit. The amplifier circuit adjusts the voltage drop across the pass element based off of the output voltage and a reference voltage.

FIG. 1 illustrates in partial block diagram and partial schematic form a LDO 100 known in the art. LDO 100 includes a reference voltage generator 101, an amplifier 102, a compensation capacitor 103, a compensation resistor 104, a parasitic capacitance 105, a buffer 106, a pass transistor 107, a first resistor 108, a second resistor 109, an output capacitor 110, and a third resistor 111. In operation, resistors 108 and 109 provide a feedback signal based on the output voltage. Amplifier 102 provides a regulation signal in response to the feedback signal and a reference voltage. Buffer 106 provides a drive signal to adjust a voltage drop across pass transistor 107 in response to the regulation signal. Buffer 106 has parasitic capacitance 105 at its input. Compensation capacitor 103 and compensation resistor 104 form a compensation network to mitigate the impact of parasitic capacitance 105; however, the frequency bandwidth is still limited.

LDOs can be sensitive to changes in supply voltage, charge noise, or other disturbances to the system. Response time to these effects is limited by the bandwidth of the LDO. Parasitic capacitances, such as parasitic capacitance 105 in FIG. 1, reduce the dominant pole frequency of the LDO and slow the LDO's response to noise and other disturbances.

In order to provide good load transient performance, LDOs need to provide suitably large bandwidth while also providing low current consumption and small circuit area.

BRIEF DESCRIPTION OF THE DRAWINGS

The present disclosure may be better understood, and its numerous features and advantages made apparent to those skilled in the art by referencing the accompanying drawings, in which.

The use of the same reference symbols in different drawings indicates similar or identical items. Unless otherwise noted, the word "coupled" and its associated verb forms include both direct connection and indirect electrical connection by means known in the art, and unless otherwise noted any description of direct connection implies alternate embodiments using suitable forms of indirect electrical connection as well.

DETAILED DESCRIPTION

Figure 2:
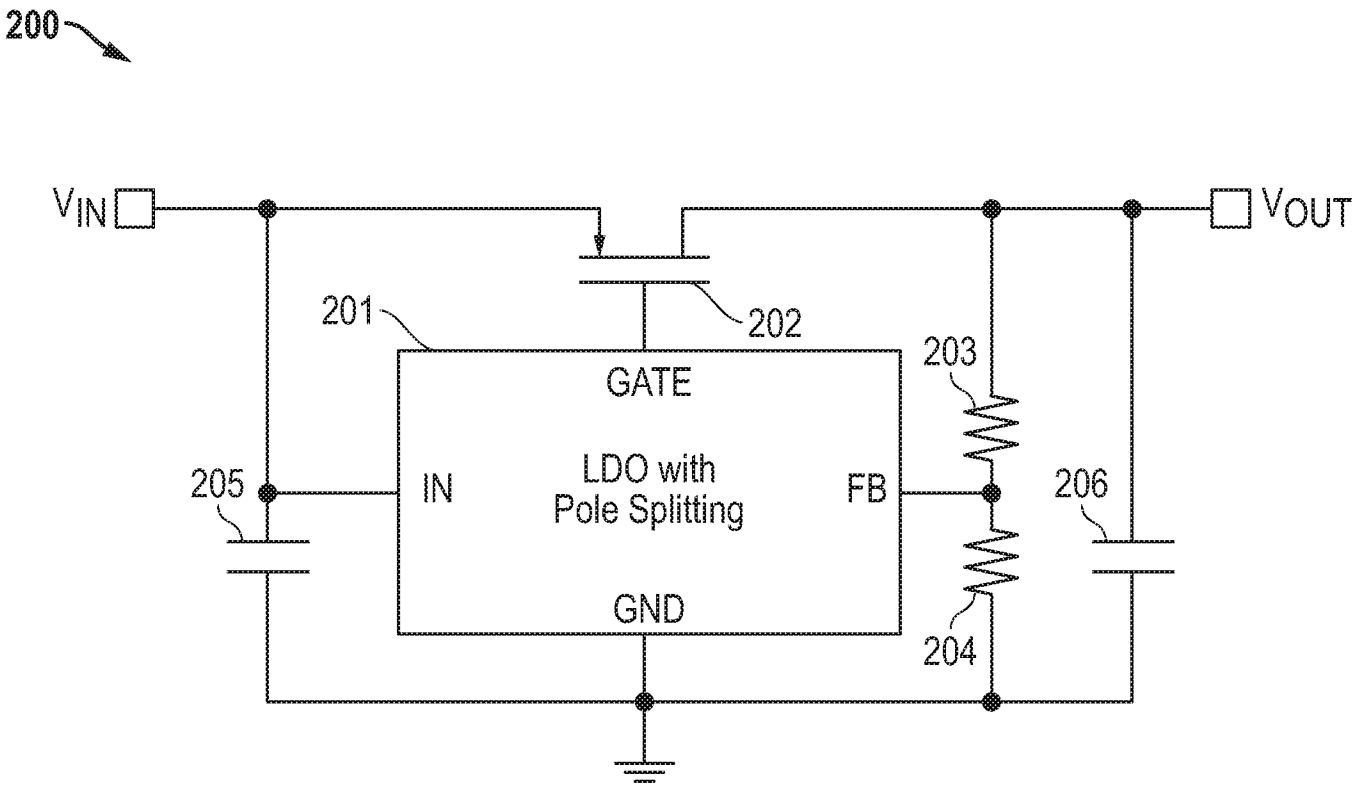
FIG. 2 illustrates in partial block diagram and partial schematic form a voltage regulating circuit according to an embodiment of the present invention.

FIG. 2 illustrates in partial block diagram and partial schematic form a voltage regulating circuit 200 according to an embodiment of the present invention. Voltage regulating circuit 200 is a low dropout regulating circuit that uses a pole splitting effect to increase frequency bandwidth. Voltage regulating circuit 200 includes a low dropout voltage regulator (LDO) 201, a pass element 202, a first resistor 203, a second resistor 204, an input capacitor 205, and an output capacitor 206.

LDO 201 is an integrated circuit that regulates the output voltage of voltage regulating circuit 200 using a pole splitting effect to increase frequency bandwidth. LDO 201 has a set of terminals labeled "GATE", "IN", "FB", and "GND". The IN terminal is connected to a voltage supply for receiving an input voltage labeled "$V_{IN}$". The GND terminal is connected to ground. Pass element 202 is a P-channel metal-oxide-semiconductor (MOS) transistor having a source connected to the IN terminal of LDO 201, a drain for providing an output voltage labeled "$V_{OUT}$" to a load (not pictured in FIG. 2), and a gate connected to the GATE terminal of LDO 201. First resistor 203 has a first terminal connected to the drain of pass element 202 and a second terminal connected to the FB terminal of LDO 201. Second resistor 204 has a first terminal connected to the FB terminal of LDO 201 and a second terminal connected to ground. Input capacitor 205 has a first terminal connected to the IN terminal of LDO 201 and a second terminal connected to primary ground. Output capacitor 206 has a first terminal connected to the drain of pass element 202 and a second terminal connected to primary ground.

Input capacitor 205 smooths $V_{IN}$ at the input of voltage regulating circuit 200. Output capacitor 206 reduces instability of $V_{OUT}$ at the output of voltage regulating circuit 200. LDO 201 is powered by $V_{IN}$ at the IN terminal.

First resistor 203 and second resistor 204 form a feedback network that provides a feedback signal representative of a scaled down $V_{OUT}$ to the FB terminal of LDO 201. LDO 201 uses the feedback signal to develop a gate driving signal to control the voltage drop across pass element 202. For example, if the load current decreases, $V_{OUT}$ and the feedback signal will increase. LDO 201 will responsively increase the voltage across pass element 202 in order to reduce $V_{OUT}$ to its target value.

Figure 3:
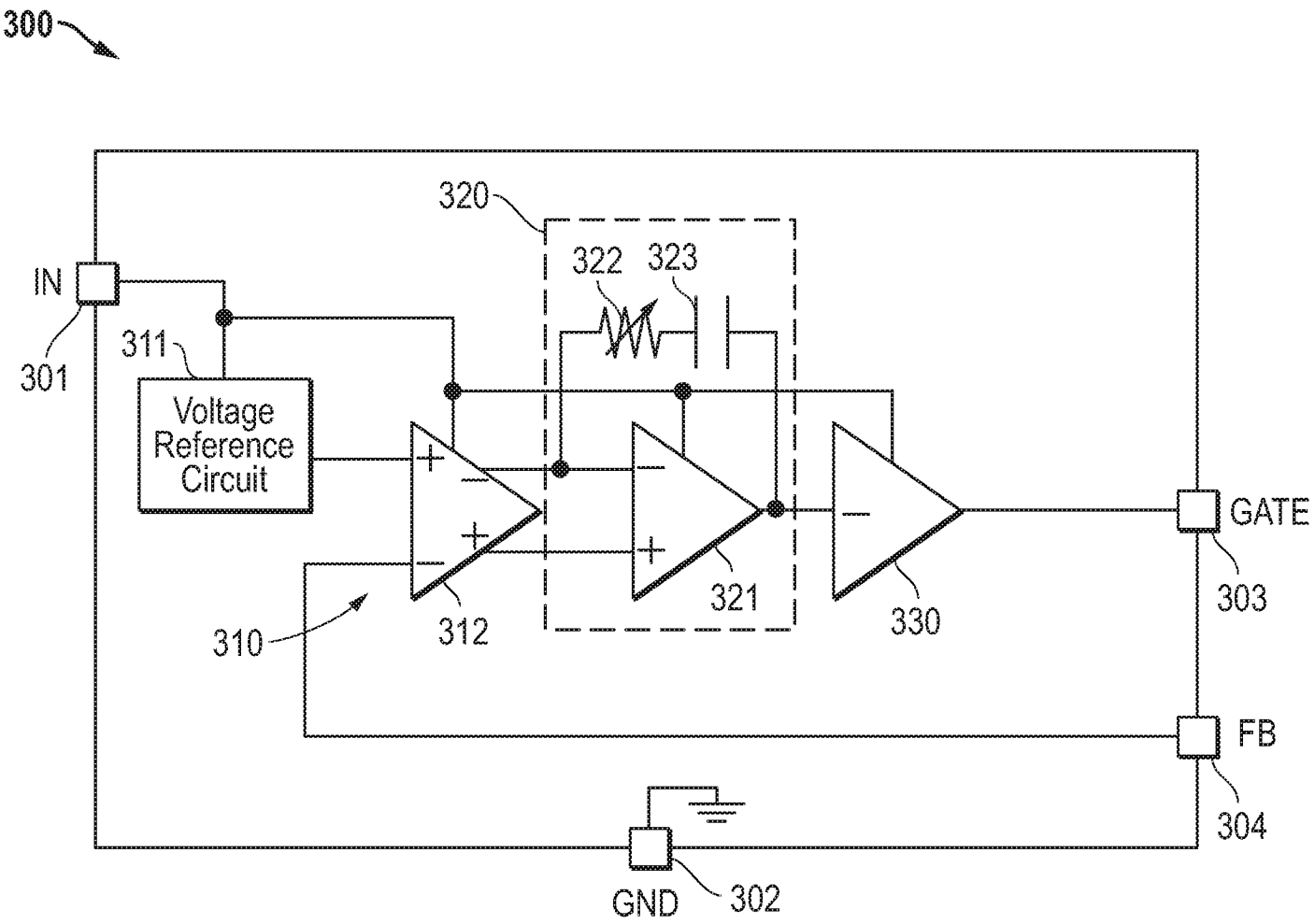
FIG. 3 illustrates in partial block diagram and partial schematic form a voltage regulator that can be used as the voltage regulator of FIG. 2.

FIG. 3 illustrates in partial block diagram and partial schematic form a voltage regulator 300 that can be used as LDO 201 of FIG. 2. Voltage regulator 300 is an integrated circuit LDO that uses a pole splitting effect to increase frequency bandwidth. Voltage regulator 300 includes an IN terminal 301, a GND terminal 302, a GATE terminal 303, a FB terminal 304, a differential stage 310, an intermediate stage 320, and a buffer stage 330.

Differential stage 310 includes a voltage reference circuit 311 and a differential amplifier 312. Voltage reference circuit 311 has an input connected to IN terminal 301 and an output for supplying a reference voltage. Differential amplifier 312 has a non-inverting input for receiving the reference voltage, an inverting input connected to FB terminal 304, a supply input connected to IN terminal 301, a first output for providing a positive component of a differential output signal, and a second output for providing a negative component of a differential output signal.

Intermediate stage 320 includes an intermediate amplifier 321, a resistive element 322, and a capacitor 323. Intermediate amplifier 321 has an inverting input connected to the second output of differential amplifier 312, a non-inverting input connected to the first output of differential amplifier 312, a supply input connected to IN terminal 301, and an output for providing an intermediate signal. Resistive element 322 is an adjustable resistor with a first terminal connected to the inverting input of intermediate amplifier 321 and a second terminal. Capacitor 323 has a first terminal connected to the second terminal of resistive element 322 and a second terminal connected to the output of intermediate amplifier 321.

Buffer stage 330 is an inverting buffer with an input terminal connected to the output of intermediate amplifier 321, a supply input connected to IN terminal 301, and an output for providing a drive signal.

In operation, voltage regulator 300 is an integrated circuit that operates as a LDO and is suitable for use as voltage regulator 201 of FIG. 2. Voltage regulator 300 regulates an output voltage ($V_{OUT}$) by generating the gate driving signal in response to a feedback signal received by FB terminal 304 and the reference voltage output from voltage reference circuit 311. A parasitic capacitance exists at the input of buffer stage 330 which limits the bandwidth of the voltage regulator. Unlike known low dropout voltage regulators, however, voltage regulator 300 includes an intermediate stage that provides a pole splitting effect to push the pole caused by the parasitic capacitance at the input of buffer stage 330 to a higher frequency and therefore to increase the bandwidth of the regulator.

Resistive element 322 and capacitor 323 provide a compensation network between the inverting input of intermediate amplifier 321 and the output of intermediate amplifier 321. The compensation network creates a low frequency pole at the inverting input of intermediate amplifier 321. The frequency for the low frequency pole is given by:

$$f_{lfeq} = \frac{1}{2\pi \times C_{lfeq} \times R_{lfeq}} \tag{1}$$

where $C_{lfeq}$ is the pole's equivalent capacitance and $R_{lfeq}$ is the pole's equivalent resistance. $C_{lfeq}$ can be calculated as:

$$C_{lfeq} = C_{comp} \times A_1 \times A_2 = C_{comp} \times \frac{g_{m2}}{g_{ds2} + g_{ds4}} \times \frac{g_{mi}}{g_{dsi}} \tag{2}$$

where $C_{comp}$ is the value of the capacitance of capacitor 323, $A_1$ is the gain of differential amplifier 312, and $A_2$ is the gain of intermediate amplifier 321. $R_{lfeq}$ can be calculated as:

$$R_{lfeq} = \frac{1}{g_{m3}} \cong \frac{1}{g_{m2}} \tag{3}$$

where $g_{m3}$ and $g_{m2}$ are transconductance components of differential amplifier 312. From equations 1, 2, and 3, the frequency of the low frequency pole can be calculated as:

$$f_{lfp} = \frac{g_{ds2} + g_{ds4}}{2\pi \times C_{comp}} \times \frac{g_{dsi}}{g_{mi}} \tag{4}$$

As previously mentioned, a parasitic capacitance exists at the input of buffer stage 330. This parasitic capacitance creates a high frequency pole which may limit the bandwidth of voltage regulator 300. The frequency for the high frequency pole is given by:

$$f_{hfp} = \frac{1}{2\pi \times C_{hfeq} \times R_{hfeq}} \tag{5}$$

where $C_{hfeq}$ is the pole's equivalent capacitance and $R_{hfeq}$ is the pole's equivalent resistance. $C_{hfeq}$ can be calculated as:

$$C_{hfeq} = \frac{C_{parasitic}}{A_1 \times A_2} = C_{parasitic} \times \frac{g_{ds2} + g_{ds4}}{g_{m2}} \times \frac{g_{dsi}}{g_{mi}} \tag{6}$$

where $C_{parasitic}$ is the value of the parasitic capacitance. $R_{hfeq}$ can be calculated as:

$$R_{hfeq} = \frac{1}{g_{dsi}} \tag{7}$$

where $g_{dsi}$ is an output conductance component of intermediate amplifier 321. From equations 5, 6, and 7 the frequency of the high frequency pole can be calculated as:

$$f_{hfp} = \frac{g_{mi} \times g_{m2}}{2\pi \times C_{parasitic} \times (g_{ds2} + g_{ds4})} \tag{8}$$

By using the compensation network, voltage regulator 300 divides the high frequency pole by voltage gains $A_1$ of differential amplifier 312 and $A_2$ of intermediate amplifier 321, which pushes the high frequency pole to a higher frequency, increasing the bandwidth.

Figure 4:
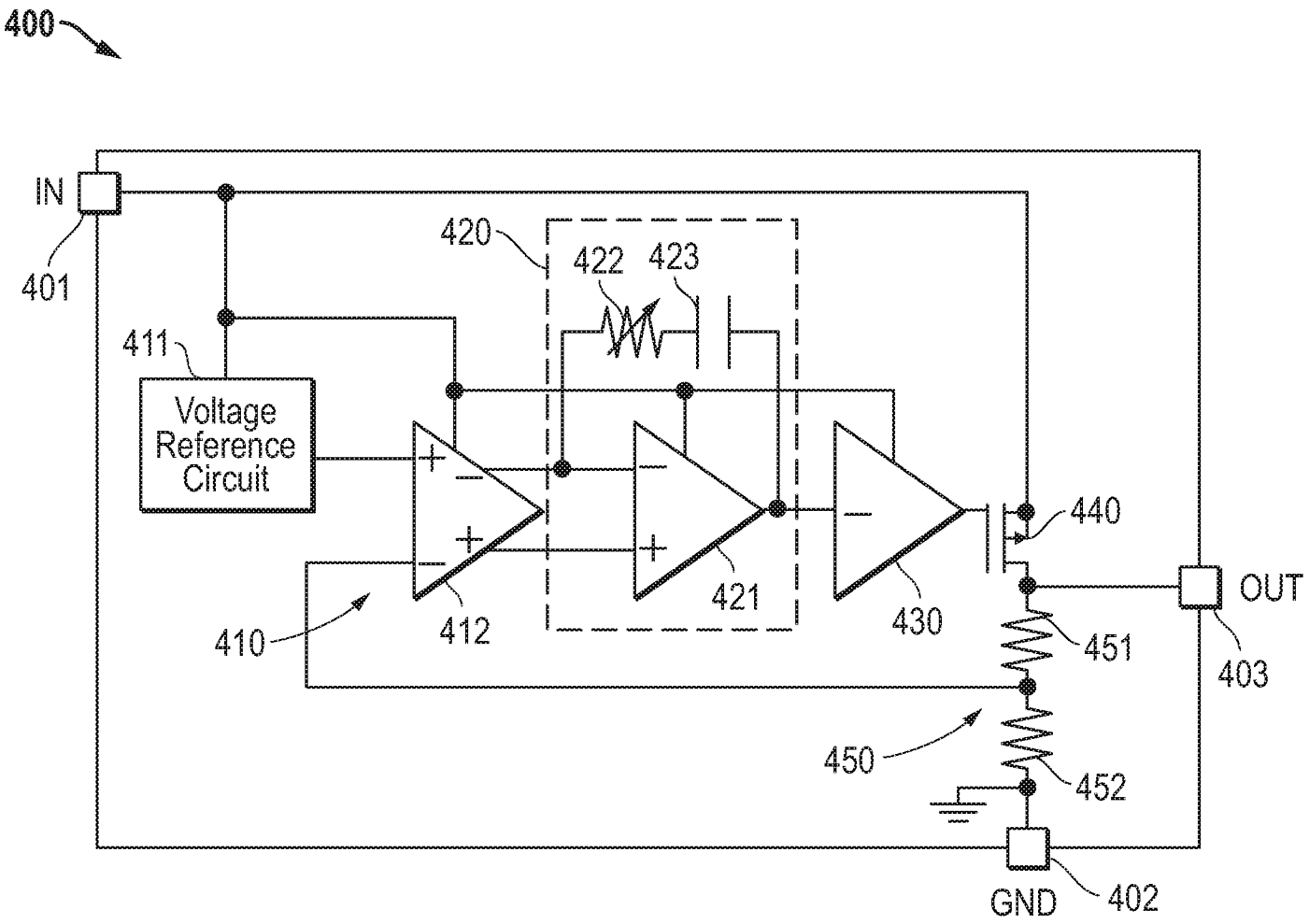
FIG. 4 illustrates in partial block diagram and partial schematic form a voltage regulator according to another embodiment of the present invention.

FIG. 4 illustrates in partial block diagram and partial schematic form a voltage regulator 400 according to another embodiment of the present invention. Voltage regulator 400 is a LDO that operates similarly to voltage regulator 300 of FIG. 3, but with a few differences described below. Voltage regulator 400 generally includes an input terminal 401 labeled "IN", a ground terminal 402 labeled "GND", an output terminal 403 labeled "OUT", a differential stage 410, an intermediate stage 420, a buffer stage 330, an output stage 440, and a feedback stage 450.

Differential stage 410 includes a voltage reference circuit 411 and a differential amplifier 412. Voltage reference circuit 411 has an input connected to IN terminal 401 and an output for supplying a reference voltage. Differential amplifier 412 has a non-inverting input for receiving the reference voltage, an inverting input for receiving a feedback voltage, a supply input connected to IN terminal 401, a first output for providing a positive component of a differential output signal, and a second output for providing a negative component of a differential output signal.

Intermediate stage 420 includes an intermediate amplifier 421, a resistive element 422, and a capacitor 423. Intermediate amplifier 421 has an inverting input connected to the second output of differential amplifier 412, a non-inverting input connected to the first output of differential amplifier 412, a supply input connected to IN terminal 401, and an output for providing an intermediate signal. Resistive element 422 is an adjustable resistor with a first terminal connected to the inverting input of intermediate amplifier 421 and a second terminal. Capacitor 423 has a first terminal connected to the second terminal of resistive element 422 and a second terminal connected to the output of intermediate amplifier 421.

Buffer stage 430 is an inverting buffer with an input terminal connected to the output of intermediate amplifier 421, a supply input connected to IN terminal 401, and an output for providing a drive signal.

Output stage 440 is a P-channel metal-oxide-semiconductor (MOS) transistor having a source connected to IN terminal 401, a gate for receiving the drive signal, and a drain connected to OUT terminal 403. Feedback stage 450 has a first terminal connected to OUT terminal 403, a second terminal for providing the feedback signal, and a third terminal connected to GND terminal 402. Feedback stage 450 includes a first resistor 451 and a second resistor 452. Resistor 451 has a first terminal connected to OUT terminal 403 and a second terminal connected to the inverting input of differential amplifier 412. Resistor 452 has a first terminal connect to the second terminal of resistor 451 and a second terminal connected to GND terminal 402.

Voltage regulator 400 operates similarly to voltage regulator 300 of FIG. 3 when used in voltage regulator circuit 200 of FIG. 2, except pass element 202 and resistors 203 and 204 of FIG. 2 are integrated on the same die as output stage 440 and feedback stage 450 respectively.

Figure 1:
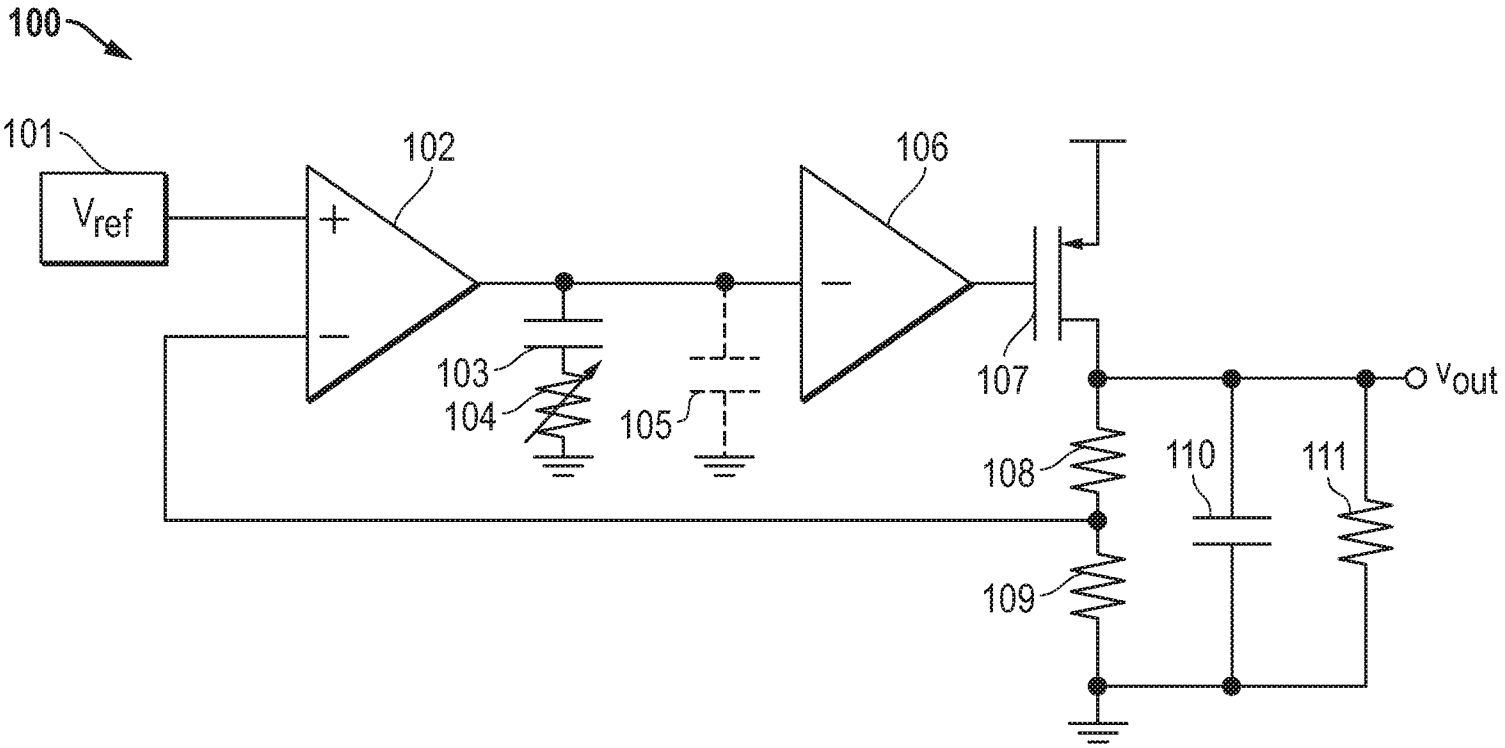
FIG. 1 (Prior Art)
FIG. 1 illustrates in partial block diagram and partial schematic form a voltage regulator known in the art.

Voltage regulators 300 and 400 provide exemplary implementations of low dropout voltage regulators that may be used in applications such as voltage regulating circuit 100 of FIG. 1. Resistive elements 322 and 422 are depicted as adjustable resistors. The resistance value of resistive elements 322 and 422 may be adjusted during processing, manufacturing, by a user, or in response to a voltage signal. In some embodiments, feedback current decreases as output voltage rises, and in these alternatives, differential amplifiers 312 and 412 and intermediate amplifiers 321 and 421 may have their polarities switched to account for the differences in feedback signal behavior. While transistor 440 is shown as a P-channel MOS transistor, other implementations may use other transistors such as bipolar junction transistors (BJTs), junction gate field-effect transistors (JFETs), or N-channel MOS transistors may be used.

Figure 5:
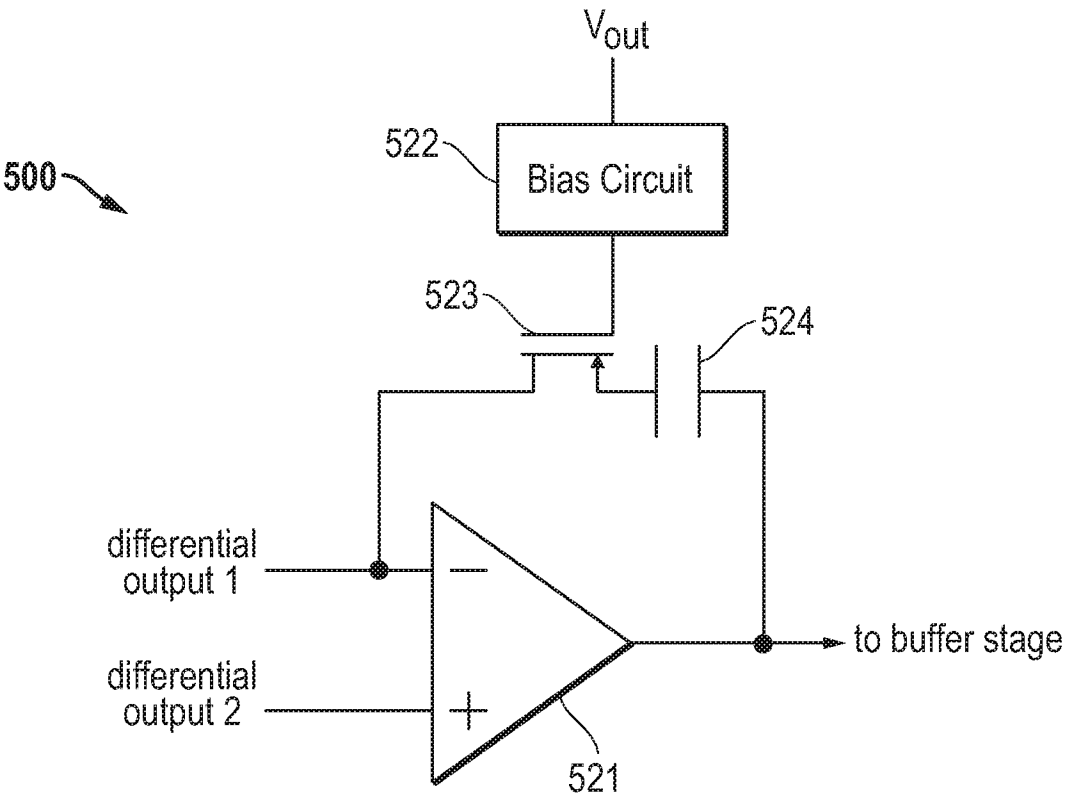
FIG. 5 illustrates in partial block diagram and partial schematic form an intermediate stage that can be used as the intermediate stage of FIGS. 3 and 4 according to other embodiments.

FIG. 5 illustrates in partial block diagram and partial schematic form an intermediate stage 500 that can be used as the intermediate stage 320 of FIG. 3 or 420 of FIG. 4. Intermediate stage 500 is an intermediate stage that behaves similarly to intermediate stage 320 of FIG. 3, but with a few differences described below. Intermediate stage 500 includes an intermediate amplifier 521, a bias circuit 522, a transistor 523, and a capacitor 524. Intermediate amplifier 521 has an inverting input for receiving the inverted differential output signal, a non-inverting input for receiving the non-inverted differential output signal, and an output for providing the intermediate signal. Bias circuit 522 has an input for receiving $V_{OUT}$ and an output for providing a biasing signal. Transistor 523 is a P-channel MOS transistor having a drain connected to the inverting input of intermediate amplifier 521, a gate for receiving the biasing signal, and a source. Capacitor 524 has a first terminal connected to the source of transistor 523 and a second terminal connected to the output of intermediate amplifier 521.

In operation, intermediate stage 500 behaves similarly to intermediate stage 320 of FIG. 3, except bias circuit 522 and transistor 523 replace resistive element 322 of FIG. 3. Bias circuit 522 receives $V_{out}$ and provides the biasing signal to adjust a drain-source resistance of transistor 523 according to $V_{out}$. Transistor 523 generates a zero that has its position changed by adjusting its drain-source resistance.

Figure 6:
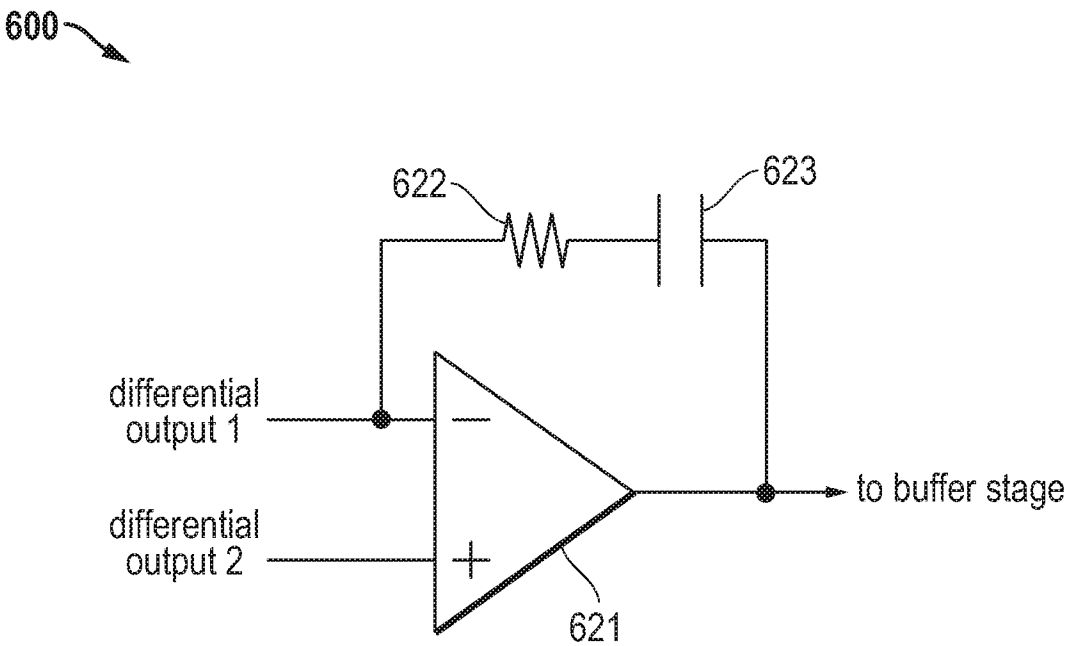
FIG. 6 illustrates in partial block diagram and partial schematic form another intermediate stage that can be used as the intermediate stage of FIGS. 3 and 4 according to yet other embodiments.

FIG. 6 illustrates in partial block diagram and partial schematic form another intermediate stage 600 that can be used as the intermediate stage 320 of FIG. 3 or 420 of 4. Intermediate stage 600 is an intermediate stage that behaves similarly to intermediate stage 320 of FIG. 3, but with a few differences described below. Intermediate stage 600 includes an intermediate amplifier 621, a resistor 622, and a capacitor 623. Intermediate amplifier 621 has an inverting input for receiving the inverted differential output signal, a non-inverting input for receiving the non-inverted differential output signal, and an output for providing the intermediate signal. Resistor 622 has a first terminal connected to the inverting input of intermediate amplifier 621 and a second terminal. Capacitor 623 has a first terminal connected to the second terminal of resistor 622 and a second terminal connected to the output of intermediate amplifier 621.

In operation, intermediate stage 600 behaves similarly to intermediate stage 320 of FIG. 3, except resistor 622 has a fixed resistance value.

Intermediate stages 320, 420, 500, and 600 provide exemplary implementations of intermediate stages for low dropout voltage regulators. By using an intermediate stage, voltage regulator 300 and 400 can have higher bandwidth, which allows faster response to perturbations such as charge noise and power supply noise.

Figure 7:
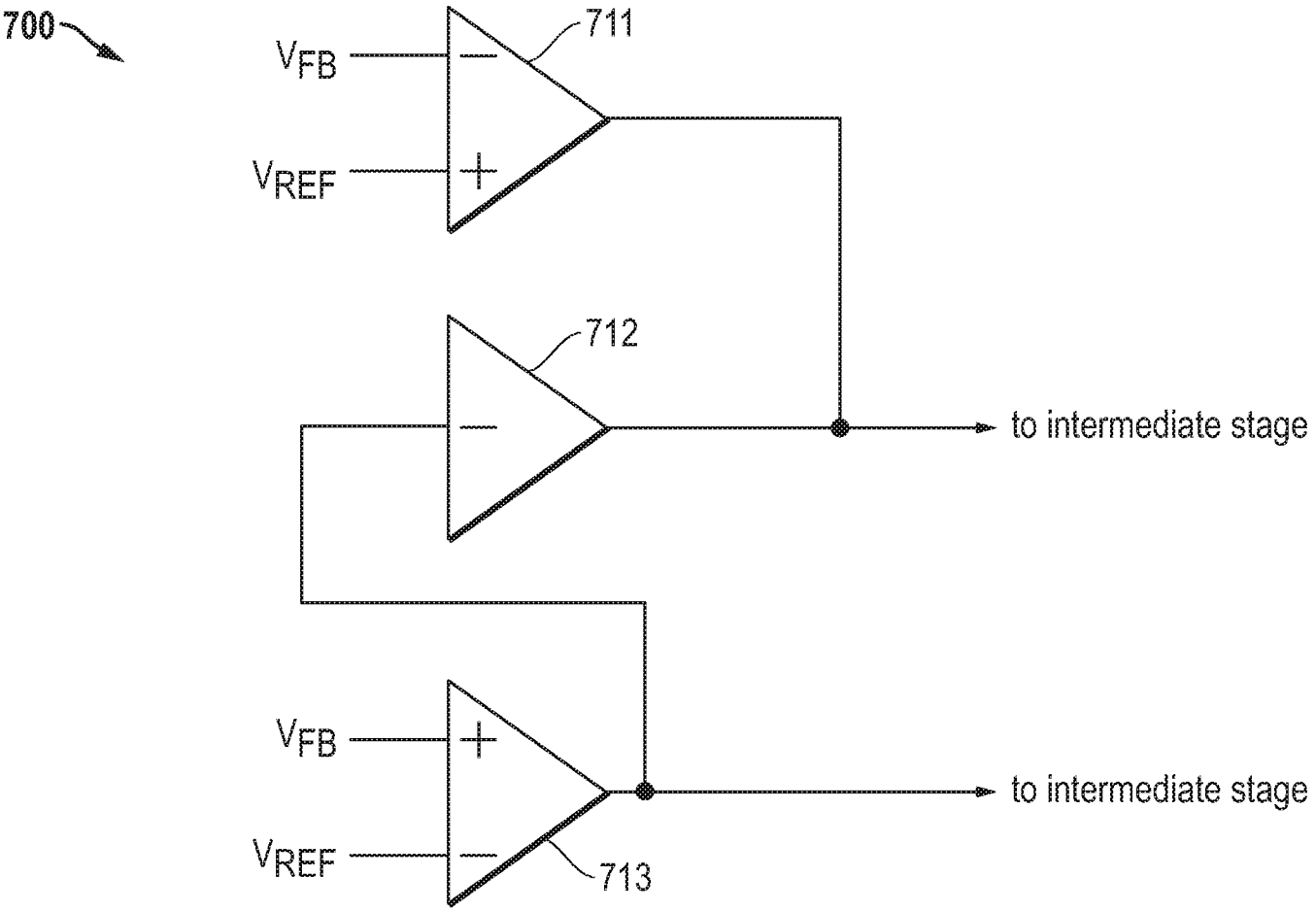
FIG. 7 illustrates in block diagram form a differential amplifier that may be used as the differential amplifier of FIGS. 3 and 4.

FIG. 7 illustrates in block diagram form a differential amplifier 700 that may be used as the differential amplifier 312 of FIG. 3 or 412 of FIG. 4. Differential amplifier 700 is an amplifier chain that behaves similarly to differential amplifier 312 of FIG. 3, but with a few differences described below. Differential amplifier 700 includes a first amplifier 711, a gain inverter 712, and a second amplifier 713. First amplifier 711 has an inverting input for receiving the feedback signal ($V_{FB}$), a non-inverting input for receiving the reference voltage, and an output for providing the non-inverted differential output signal. Gain inverter 712 has an input for receiving the inverted differential output signal and an output connected to the output of first amplifier 711. Second amplifier 713 has a non-inverting input for receiving $V_{FB}$, an inverting input for receiving the reference voltage, and an output for providing the inverted differential output signal.

In operation, differential amplifier 700 implements differential amplifier 312 of FIG. 3 using only single-ended output amplifiers.

Thus various embodiments of a voltage regulator, an intermediate stage, and their operation have been described.

The various embodiments provide improved bandwidth for low dropout voltage regulators. They also provide improved power supply ripple rejection (PSRR) in DC/DC converters.

The above-disclosed subject matter is to be considered illustrative, and not restrictive, and the appended claims are intended to cover all such modifications, enhancements, and other embodiments that fall within the true scope of the claims. For example, the particular values of starting and ending frequencies and voltages that a voltage regulator chip supports can vary in different embodiments. Moreover, in other embodiments, different components of the voltage regulating circuits shown in FIGS. 2 and 3 can be integrated on a single semiconductor chip, or included in a single integrated circuit package.

Thus, to the maximum extent allowed by law, the scope of the present invention is to be determined by the broadest permissible interpretation of the following claims and their equivalents, and shall not be restricted or limited by the forgoing detailed description.

What is claimed is:

1. A low dropout voltage regulator that in one configuration provides a drive signal to regulate an output voltage in response thereto, comprising:

an error amplifier having a first input for receiving a reference voltage, a second input for receiving a feedback signal representative of the output voltage, a first output, and a second output;

an intermediate amplifier having a first input coupled to said first output of said error amplifier, a second input coupled to said second output of said error amplifier, and an output;

a buffer amplifier having a first input coupled to said output of said intermediate amplifier, and an output for providing the drive signal; and a compensation network having a first terminal coupled to said first input of said intermediate amplifier, and a second terminal coupled to said output of said intermediate amplifier, wherein said compensation network pushes a frequency of a pole created by a parasitic capacitance at an input of said buffer amplifier to a higher frequency based on a gain of said intermediate amplifier.

2. The low dropout voltage regulator of claim 1, wherein said compensation network comprises:

a series combination of a resistive element and a capacitor coupled between said first input of said intermediate amplifier and said output of said intermediate amplifier.

3. The low dropout voltage regulator of claim 2, wherein said capacitor has a size that defines a low frequency pole whose frequency is lower than said frequency of said pole created by said parasitic capacitance and whose frequency is also proportional to a gain of said intermediate amplifier.

4. The low dropout voltage regulator of claim 2, wherein said resistive element has an adjustable resistance value.

5. The low dropout voltage regulator of claim 4, wherein said resistive element is an adjustable resistance circuit comprising a transistor having a control input for varying said adjustable resistance value in response to said output voltage.

6. The low dropout voltage regulator of claim 1, wherein said error amplifier comprises:

a first amplifier having a first input for receiving said feedback signal, a second input for receiving said reference voltage, and an output for providing said second output of said error amplifier;

a second amplifier having a first input for receiving said feedback signal, a second input for receiving said reference voltage, and an output for providing said first output of said error amplifier; and a third amplifier having an input coupled to said output of said second amplifier and an output coupled to said output of said first amplifier.

7. The low dropout voltage regulator of claim 1, further comprising an output transistor having a first current electrode for receiving an input voltage, a second current electrode for supplying said output voltage, and a control electrode coupled to said output of said buffer amplifier.

8. The low dropout voltage regulator of claim 7, wherein said output transistor is a p-channel MOSFET.

9. The low dropout voltage regulator of claim 7, further comprising:

a voltage divider circuit having a first terminal coupled to said second current electrode of said output transistor, a second terminal coupled to said second input of said error amplifier, and a third terminal coupled to a power supply terminal.

10. A voltage regulating circuit, comprising:

a differential stage having an output for providing a differential signal in response to a difference between a feedback signal and a reference signal;

an intermediate stage responsive to said differential signal, having an output for providing a first output signal, wherein said intermediate stage includes a compensation network for providing a pole splitting effect to said differential signal and said first output signal; and a buffer stage responsive to said first output signal, having an output for providing a buffered signal, wherein said compensation network pushes a frequency of a pole created by a parasitic capacitance at an input of said buffer stage to a higher frequency based on a gain of said intermediate stage;

an output stage responsive to said buffered signal, having an output for providing an output voltage; and a feedback stage for providing said feedback signal in response to said output voltage.

11. The voltage regulating circuit of claim 10, wherein said compensation network comprises:

a series combination of a resistive element and a capacitor coupled between an input of said intermediate stage and said output of said intermediate stage.

12. The voltage regulating circuit of claim 11, wherein said capacitor has a size that defines a low frequency pole whose frequency is lower than said frequency of said pole created by said parasitic capacitance and whose frequency is also proportional to a gain of said intermediate stage.

13. The voltage regulating circuit of claim 11, wherein said resistive element has an adjustable resistance value.

14. The voltage regulating circuit of claim 13, wherein said resistive element is an adjustable resistance circuit comprising a transistor having a control input for varying said adjustable resistance value in response to said output voltage.

15. The voltage regulating circuit of claim 10, wherein said differential stage comprises:

a first amplifier having a first input for receiving said feedback signal, a second input for receiving a first reference voltage, and an output for providing a first component of said differential signal;

a second amplifier having a first input for receiving said feedback signal, a second input for receiving a second reference voltage, and an output for providing a second component of said differential signal; and a third amplifier having an input coupled to said output of said second amplifier and an output coupled to said output of said first amplifier.

16. The voltage regulating circuit of claim 10, wherein said differential stage, said intermediate stage, said buffer stage, said output stage, and said feedback stage are combined within a single integrated circuit chip.

17. The voltage regulating circuit of claim 10, wherein said differential stage, said intermediate stage, and said buffer stage are combined within an integrated circuit package, and said output stage and said feedback stage are external to said integrated circuit package.

18. A method for regulating a voltage, comprising:

amplifying a difference between a feedback voltage proportional to an output voltage and a reference voltage to form a differential signal, wherein said differential signal has a positive component and a negative component; and compensating said differential signal, wherein said compensating comprises:

amplifying said differential signal to provide an intermediate signal; and adjusting said intermediate signal with a capacitance between said negative component of said differential signal and said intermediate signal, amplifying said intermediate signal to provide a buffered signal, wherein said adjusting comprises pushing a frequency of a pole created by a parasitic capacitance associated with amplifying said intermediate signal to a higher frequency based on a gain of said amplifying said differential signal; and generating said output voltage using said buffered signal.

19. The method of claim 18, wherein said compensating further comprises:

adjusting a resistance between said negative component of said differential signal and said intermediate signal.

20. The method of claim 19, wherein said adjusting said resistance is in response to a modulation of said output voltage.

* * * * *